US008408389B1

(12) United States Patent
Anderson

(10) Patent No.: US 8,408,389 B1
(45) Date of Patent: Apr. 2, 2013

(54) BUTTON ACTIVATED DISPENSING CAP FOR A LIQUID CONTAINER

(75) Inventor: Michael R. Anderson, Boca Raton, FL (US)

(73) Assignee: Blast Max LLC, Reno, NV (US)

( * ) Notice: Subject to any disclaimer, the term of this patent is extended or adjusted under 35 U.S.C. 154(b) by 0 days.

(21) Appl. No.: 12/649,449

(22) Filed: Dec. 30, 2009

Related U.S. Application Data

(60) Provisional application No. 61/141,680, filed on Dec. 31, 2008.

(51) Int. Cl.
*B65D 25/08* (2006.01)

(52) U.S. Cl. ..... 206/222; 206/568; 215/DIG. 8

(58) Field of Classification Search ..... 206/222, 206/250, 219, 145, 568; 222/454, 448, 47; 141/22, 320, 321, 322; 215/DIG. 8
See application file for complete search history.

(56) References Cited

U.S. PATENT DOCUMENTS

| | | | | |
|---|---|---|---|---|
| 3,156,369 | A | 11/1964 | Bowes et al. | |
| 4,638,927 | A | 1/1987 | Morane | |
| 5,246,142 | A | 9/1993 | DiPalma et al. | |
| 5,370,222 | A | 12/1994 | Steigerwald et al. | |
| 5,692,644 | A | 12/1997 | Gueret | |
| 5,863,126 | A | 1/1999 | Guild | |
| 5,927,549 | A * | 7/1999 | Wood | 222/83 |
| 5,967,309 | A * | 10/1999 | Robles-Gonzalez et al. | 206/221 |
| 6,098,795 | A * | 8/2000 | Mollstam et al. | 206/222 |
| 6,148,996 | A * | 11/2000 | Morini | 206/222 |
| 6,165,523 | A * | 12/2000 | Story | 426/112 |
| 6,372,270 | B1 * | 4/2002 | Denny | 426/77 |
| 6,705,462 | B2 * | 3/2004 | Kasuya | 206/222 |
| 6,840,373 | B2 * | 1/2005 | Gibler et al. | 206/219 |
| 6,854,595 | B2 * | 2/2005 | Kiser | 206/222 |
| 7,347,322 | B2 * | 3/2008 | Cho | 206/222 |
| 7,740,134 | B2 * | 6/2010 | Sweeney et al. | 206/221 |
| 2005/0161348 | A1 * | 7/2005 | Morini | 206/219 |
| 2006/0144727 | A1 * | 7/2006 | Fontana | 206/222 |

FOREIGN PATENT DOCUMENTS

WO WO 2006111803 A2 * 10/2006

* cited by examiner

*Primary Examiner* — J. Gregory Pickett
*Assistant Examiner* — Ernesto Grano
(74) *Attorney, Agent, or Firm* — Malin Haley DiMaggio & Bowen, P.A.

(57) ABSTRACT

A three piece sealed dispensing and storage cap that is inserted onto the neck of a liquid bearing container threaded neck of a bottle, said device being a storage chamber for sealably containing a liquid and/or dry material and a dispenser for releasing the material when desired into the primary container. The dispensing cap may include a desiccant to prevent moisture from reaching the storage chamber. The bottom seal that is frangible and ruptured to activate the device may include a line of weakening. The button top is depressed manually forcing an actuator against the bottom of the cap body seal to rip away the bottom seal dispensing the material. The present invention allows the use of materials that would discolor, degrade or interact with other substances when added to the contents of the bottle, to remain stable and/or inactive until the time of use.

6 Claims, 4 Drawing Sheets

BUTTON ACTIVATED DISPENSING CAP FOR A LIQUID CONTAINER

BACKGROUND OF THE INVENTION

1. Field of the Invention

This invention relates to a liquid and/or dry ingredient button activated dispensing cap that is threadably (or non-threaded) mounted to the body of a primary container bottle, pack, pouch, carton, drum, can or any other liquid (or non-liquid) container. The dispensing cap stores liquid and/or dry substances which can be rapidly dispensed into the primary container by manual activation of a button actuator when desired. The mixed contents can be thereafter readily consumed by the user after the cap body is removed from the primary container.

2. Description of the Prior Art

Many foods, drugs, cosmetics, mouth washes, adhesives, polishes, cleansers, dyes and other substances are compounds or mixtures that are frequently supplied in liquid, powder or crystal form and do not retain their stability, strength and effectiveness for long after the ingredients have been mixed in solution or suspension with a different liquid. This incompatibility after mixing therefore mandates that the product be utilized relatively soon after mixture to obtain full strength benefits or to prevent loss of effective strength, deterioration, discoloration, interactions and reduce effectiveness. It is also important that admixtures of various ingredients be done under conditions wherein a measured amount of one ingredient is added to a measured amount of the other liquid or chemical to insure that proper results are obtained. The process of loss of effectiveness is often termed "shelf life." Once two different chemicals are combined, the process of deterioration often begins.

Another concern involves merchandising of certain products, where it is frequently desirable to supply two companion products to the consumer in a single package. Thus, many products are, by their very nature, required to be used by the consumer shortly after their manufacture and mixture as they lose certain desirable characteristics with a short period of time, yet the product can be stored for extended periods of time if one ingredient is maintained separate from the other. In such case, the two ingredients may be mixed together to form the desired product shortly before use. In marketing such goods, it obviously is desirable that both ingredients be sold as part of the same package. From an aesthetic as well as a handling standpoint, it is desirable that but a single package be utilized for maintaining such compounds separated.

The use of conventional liquid containers such as plastic bottles for carrying water, juices, power drinks and other desirable liquids for human consumption is quite well known. There are, however, several non-active and active substances such as activated oxygen, vitamins, minerals, herbs, nutrients and flavors that would be desirable to be added to liquids such as water, juices or other beverages to give the consumer added benefits, particularly those useful for the health of the consumer. Many of the substances, however, that provide additional benefits when mixed into another liquid have short shelf lives, discolor, interact or degrade quickly when combined with liquids or other substances. Therefore, many beverages are currently sold without the added beneficial ingredients.

It is known in the art to provide dispensers containing a concentrate of soluble materials to a fixed quantity of solute, usually water, for dispensing. Thus, the prior art teaches containers for beverages wherein the interior of the container is divided into a compartment having a basic ingredient and a compartment which can be ruptured so as to mix, within the container the basic ingredient and some form of modifier, diluent or flavoring. The basic reason for this prior art container is to provide the mixing action at the time of consumption since prior mixing would have adverse effects. The basic ingredient is often not suitable for consumption by itself and requires mixing with a diluent/modifier prior to consumption.

Prior art intra-container mixing prior to use was disclosed in U.S. Pat. No. 5,370,222 to Steigerwald comprising an open threaded container containing a liquid, a powder containing releasable receptacle sealed with foil which is cut by a cutting mandrel during screwing of the receptacle onto the container.

U.S. Pat. No. 5,863,126 to Guild discloses a baby bottle fluid mixing system comprising a pre-stored powdered substance confined within a first upper container screw disposed atop a second lower container separated by an internal stemmed disk sealed in a snap fit arrangement at the aperture between the bottles, which descends into the lower bottle after removal from the aperture for use. The present invention discloses a dispensing cap body screwed onto a liquid containing bottle.

Another such device for separate storage and subsequent mixing of two products is disclosed in U.S. Pat. No. 5,246,142 to DiPalma which comprises a first ingredient container, a second ingredient dispenser compartment plunger arrangement with a weakened wall region inserted within and separated from the container, a removable container closure connected to the plunger and a plunger projection for engagement which ruptures the weakened wall region to release the second ingredient into the first ingredient container. Unlike the present invention, DiPalma's singular sealing means is the reservoir for the second ingredient and fails to create upon activation an orifice for immediate dispensing of the mixed products.

U.S. Pat. No. 5,692,644 to Gueret discloses a container separately storing, then mixing and dispensing two products in which a first liquid containing bottle is separated by a movable wall from a second reservoir containing powder. Force applied to a cylindrical piston in the direction toward the dispensing orifice of the container cuts the seal between the two reservoirs, thereby facilitating the combination and mixing of the two products within the first reservoir of the container. The Gueret apparatus differs from all embodiments of the present invention in that the piston is an integral portion of the slideable base which is snapably attached to the bottle and when compressed with external manual pressure breaks the seals, pushing the contents up into the bottom portion of the liquid-containing bottle thereby accomplishing the mixing of the two products and simultaneously reducing the exterior dimensions of the bottle. The present invention dispenses the dry product without a piston or slideable base integrated within the bottle nor does the overall size of the bottle change during use.

Another separate storage and dispensing device was disclosed in U.S. Pat. No. 4,638,927 to Morane which comprised a bottle for liquid having at its neck a leak proof envelope separately storing and enclosing additional product, with a slidable push button perforator in the cap on the bottle neck which opens the envelope to discharge the envelope contents into the liquid in the bottle, thereafter being dispensed through a duct in the cap rather than passing through the perforated center cap area as is the case with the present invention.

U.S. Pat. No. 3,156,369 issued to Bowes, et al. on Nov. 10, 1964 shows a bicameral container that includes a bottle cap dispenser.

Child safety is a concern with respect to dispensing containers to ensure that the dispensing process does not entail creating small frangible items or pieces of foil or paper that could harm a child.

The cost of manufacturing must always be considered in determining whether or not a containing dispenser is practical in everyday use.

The present invention provides a liquid and/or dry ingredients containing dispensing cap that is threadably mounted on a container neck of any type liquid container including packs, bags, cans and plastic or glass bottles. With a bottle as an example, the invention may be mounted typically on top of the neck or throat of a liquid container, such as a bottle of water. The device includes a manual push button dispenser. The stored ingredients are completely sealed within the storage compartment body, and remain separated from the liquid in the bottle until the exact moment of usage, which is determined by the consumer by manually depressing the button actuator dispensing the ingredients (powder or liquid). The dispensing cap be mounted to any type of threaded circular opening affixed or part of any type of package or carton. Thus, active ingredients, e.g. activated oxygen, vitamins, herbs, nutrients or other substances having a short activity life (shelf life) when added to a particular liquid can now be safely and sealably stored in a dispensing device until time for use and can be subsequently added to the desired liquid, thereby ensuring that the shelf life and time of activity of the materials are not jeopardized even though they are housed within the liquid container. Once activated, the contents of the bottle can be consumed by the user by removing the device from the primary container opening.

The present invention also offers the advantage that it does not require significant modification of existing liquid containers, packages, cartons, bottle caps or existing bottles. In fact, it can be inserted onto existing primary container threaded openings, bottle necks and spouts.

The dispensing device may be added at the factory to a liquid bearing container and pre-mounted on the primary container threaded opening at the factory after the container itself is partially filled with a liquid or used with an existing container. The dispensing device can be sold separately or prepackaged in the beverage container.

SUMMARY OF THE INVENTION

An ingredient dispensing device threadably mounted or mountable to a primary container for sealably containing separate liquid and/or powder materials, said dispensing device having substantially a cylindrical liquid-impervious sleeve integrally formed with a threaded peripheral container cap body. A button actuator is slideably mounted to the cap body. A cylindrical storage chamber fits moveably inside the cap body sleeve. When the button actuator is depressed, a safety seal is broken, and the button actuator contacts the storage chamber top contact area, forcing the storage chamber downward, tearing the bottom seal on the cap body sleeve.

The threaded cap body includes a cylindrical sleeve cylinder having a sealed closed end and an open end surrounded by a peripheral extended annular lip. The bottom of the cap body sleeve is sealed with a foil or molded plastic having a line of weakening. The cap body is made of a liquid impervious material such as plastic, polypropylene or polyethylene but not limited thereto. Other materials are suitable. However, the threaded cap body could also be made of metal, glass or fabric. The sealed bottom end wall of the cap body sleeve is integrally molded with the cylinder wall as a single piece with the bottom end wall having a thinner annular area near its perimeter to act as a weakened fungible sleeve bottom end cap.

The button actuator has an inverted cylindrical shape with a central plunger projection that is pressed against a contact area or center wall area at the top of the storage chamber. The button actuator exterior top surface acts as a button shaped surface to be manually depressed.

The cylindrical wall forming the button actuator is sized in diameter to fit in an upper circular slot in the threaded cap body upper surface surrounding the cap body sleeve that receives the ingredient storage chamber.

The ingredient storage chamber is a cylinder having an open bottom end with a cutting edge and a top center contact area that engages the button dispensing actuator. The outside diameter of the storage chamber is less than the inside diameter of the threaded cap sleeve, such that the storage chamber fits inside the threaded cap sleeve. The perimeter defining the bottom open end of the storage chamber cylinder formed by the cylinder wall is annular and includes a cutting edge.

The bottom wall of the threaded cap sleeve cylinder has a weakened area around its bottom periphery. When the storage chamber is manually forced downwardly by the bottom actuator, the bottom wall separates, dispensing the contents, while remaining attached to the cap sleeve cylinder.

In the preferred embodiment of the invention, the ingredient storage chamber sealably fits inside the threaded cap sleeve in the unused position, forming a dispenser with ingredients stored inside. The button actuator fits above the storage chamber on the top of the threaded cap body. The ingredients can be liquid or granular or powder and are placed in the cap body at the factory. With the ingredients in place in the storage chamber and cap body sleeve, the button actuator fits inside the cap body containing the ingredients and is pushed downwardly to the safety seal. Thus, the dispensing cap has a closed top and a sealed bottom that act as a unit.

The entire dispensing device which includes a threaded primary container top opening could also be mounted into the threaded circular wall of a carton, package, or flexible container. As an example, a bottle of water can be covered by the dispensing cap that is screwed onto the bottle neck.

At the time of use, the button top is be manually depressed, forcing the storage chamber downwardly manually until the storage chamber bottom edge engages the sealed bottom of the cap sleeve, ripping and tearing away portions of the bottom sealed wall along the lines of weakening causing the contents, liquid or powder, to be quickly dispensed by gravity into the liquid in the bottle, which in this example contains water. The different types of ingredients and uses are extensive. Packages for hair coloring, kitchen foods such as steak and marinate or herbs, automotive products and oral tooth care products are a few examples of a variety of products that may require use of two different liquid or powder chemicals that must be separated until actual use.

Once the ingredients are thoroughly mixed with the liquid in the primary container, the user can drink directly from the primary container (bottle) by removing (unscrew) the entire dispensing device from the primary container (bottle). The dispensing device, once sealed at the factory, is self-contained and can be sold independently and later put onto the threaded opening in a liquid container, pouch, carton, jug, can or the like or can be added at the factory when the liquid is added to the bottle. The purpose of having a separate dispensing container is to extend the shelf lives of the combined ingredients contained within the device with the container ingredients. Many ingredients have a short shelf life once added to a liquid such as water or other drink. By having the individual devices that are completely sealed until the time of use, the active ingredients can be kept separate from the main ingredient such as the liquid in the bottle, carton, package or container.

In yet another embodiment, the dispensing cap could have two or more compartments formed with dividers to separate different chemicals for dispensing from one cap body.

It is an object of the invention to provide a threaded dispensing device that includes active ingredients that can be readily dispensed into any type of primary container housing a second material at a desired time, thus not interfering with the shelf life or physical/chemical integrity of the ingredients to be combined.

It is an object of this invention to provide a liquid and/or dry ingredient bearing receptacle that includes a dispenser to allow consumers to dispense the liquid or powder into the liquid bearing container, pouch, package, carton at any time, the dispensing device being housed within the liquid containing container in a sealed condition.

Still another object of this invention is to provide for sanitary release of the desired ingredients from a dispensing device of any size or shape into a liquid-containing package at a time selected by the consumer.

In accordance with these and other objects which will become apparent hereinafter, the instant invention will now be described with particular reference to the accompanying drawings.

DETAILED DESCRIPTION OF THE INVENTION

Figure 1:
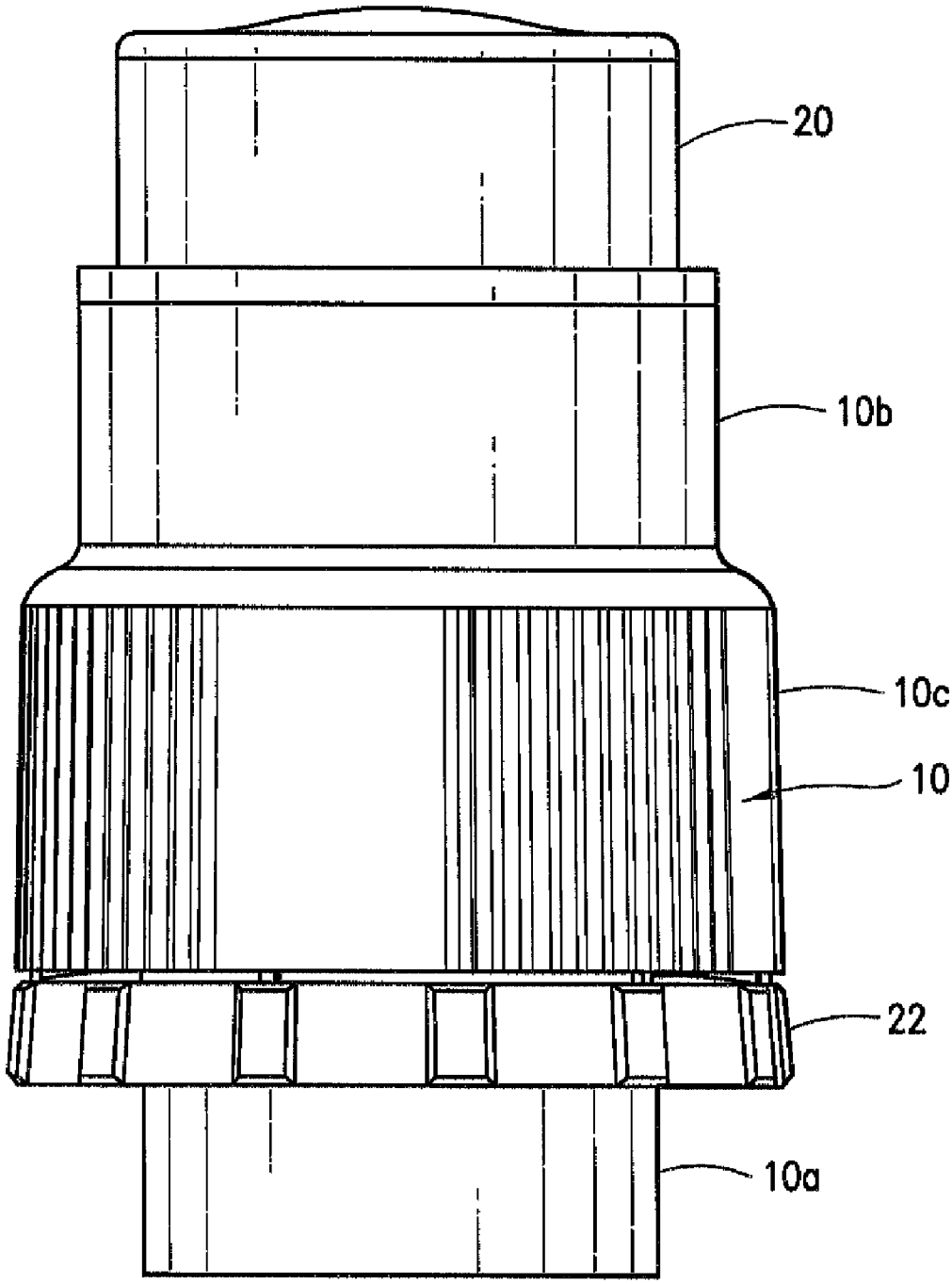
FIG. 1 is an elevational view of the present invention.

Referring now to the drawings in a particular FIG. 1, the present invention is shown that includes a threaded cap body 10 that has an extended interior cylindrical sleeve 10*a* which is substantially a tubular like passage through the cap body 10. The outside of the cap body includes a twisting surface 10*c* for manually attaching or removing the entire cap body from a threaded bottle neck or other threaded circular neck opening on packaging, pouches or other types of containers. The cap body 10 also includes a circular cylindrical portion 10*b* which is the upper wall of the cap body that includes a circular groove or slot 11 that receives the button actuator 20. The cap body 10 also includes a safety seal 22 which is a tear off to remove the entire device from a threaded bottle neck or the like.

Figure 2:
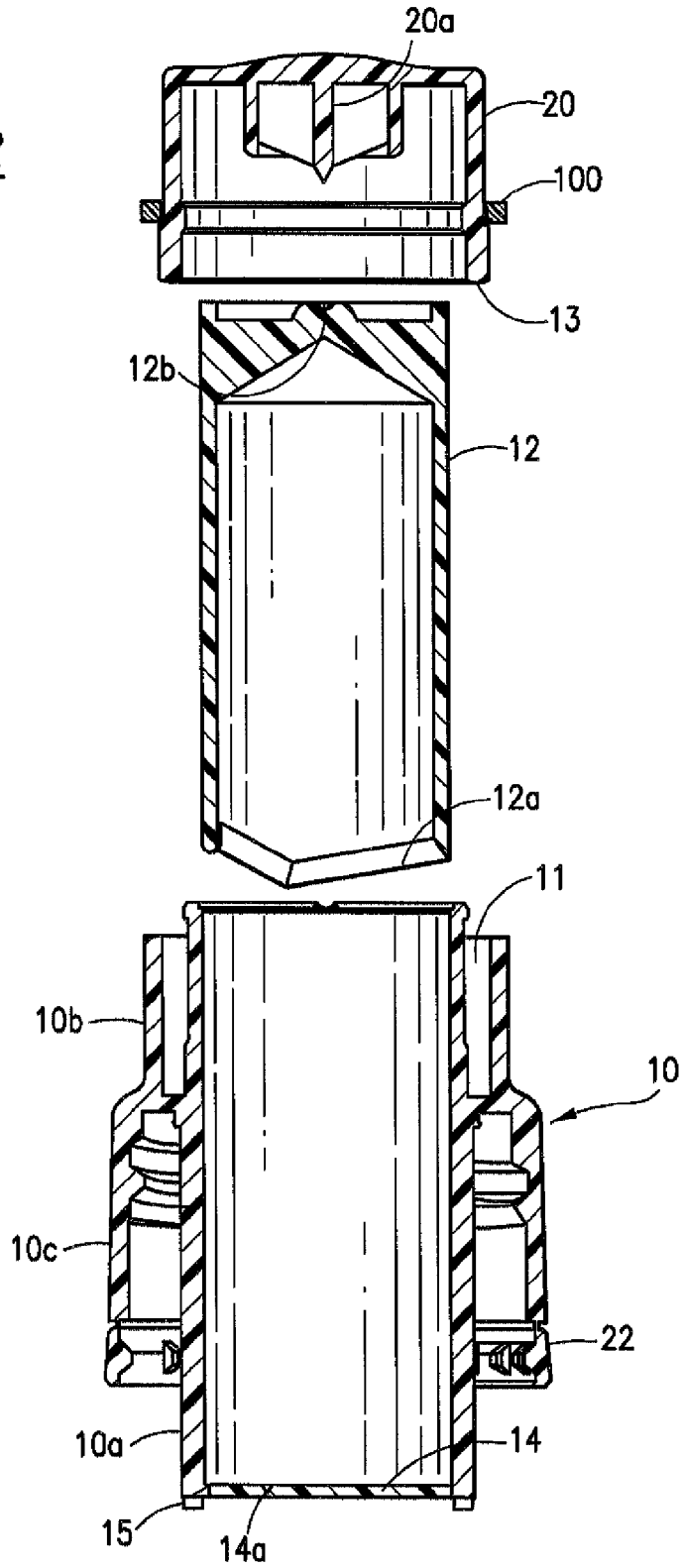
FIG. 2 shows an exploded elevational view in cross section of the present invention.

Referring now to FIG. 2, the entire device is shown in an exploded view. The button actuator 20 is disposed at the top of the device and includes a safety ring 100 that allows the device to be actuated by depressing the button actuator 20 in a downward direction causing the safety ring 100 to be broken away, allowing the button actuator 20 to proceed downwardly into the cap body, explained in further detail below.

A cylindrical ingredient storage chamber 12 is shown. The base opening includes a bladed or cutting edge 12*a* that surrounds the bottom periphery of the ingredient storage chamber 12. The top of the storage chamber includes a contact area 12*b* which is basically a ribbed member having a central area that allows the entire ingredient storage chamber to be depressed downwardly causing the cutting edge 12*a* to intersect a sealed base 14 in the cap body 10. The ingredient storage chamber 12 fits snuggly inside the cap body sleeve 10*d* that is concentrically formed in the cap body that includes the extended base portion 10*a*. The outside diameter of the ingredient storage chamber 12 is sized to fit snuggly on the inside diameter of sleeve 10*d* in the cap body 10.

The cap body 10 includes a threaded portion and exterior threaded housing 10*c* that allows it to fit on a bottle cap neck which is also threaded or any other type of container that has a circular threaded neck that is the opening into or out of the primary container. Thus the cap body 10 serves as a primary container cap that can be threadably closed and sealed on top of a container such as a plastic or glass water bottle. The cap 10 also includes a safety seal 22 that prevents removal of the cap 10 from a bottle until the safety seal 22 has been ripped apart and away from the cap body 10. In addition the cap body includes an upper cylindrical portion 10*b* that has a circular slot 11 that surrounds the cylindrical sleeve 10*d* that allows the button actuator 20 cylindrical body to slide downwardly during the activation process as it is attached to the cap body 10. In addition to the bottom sealed wall 14 which includes lines of weakening to allow dispensing of the material from the cap body ingredient storage chamber 12, an additional sealing ring 15 could be applied to the base of cap body 10 for sealing the base of the unit.

Figure 3:
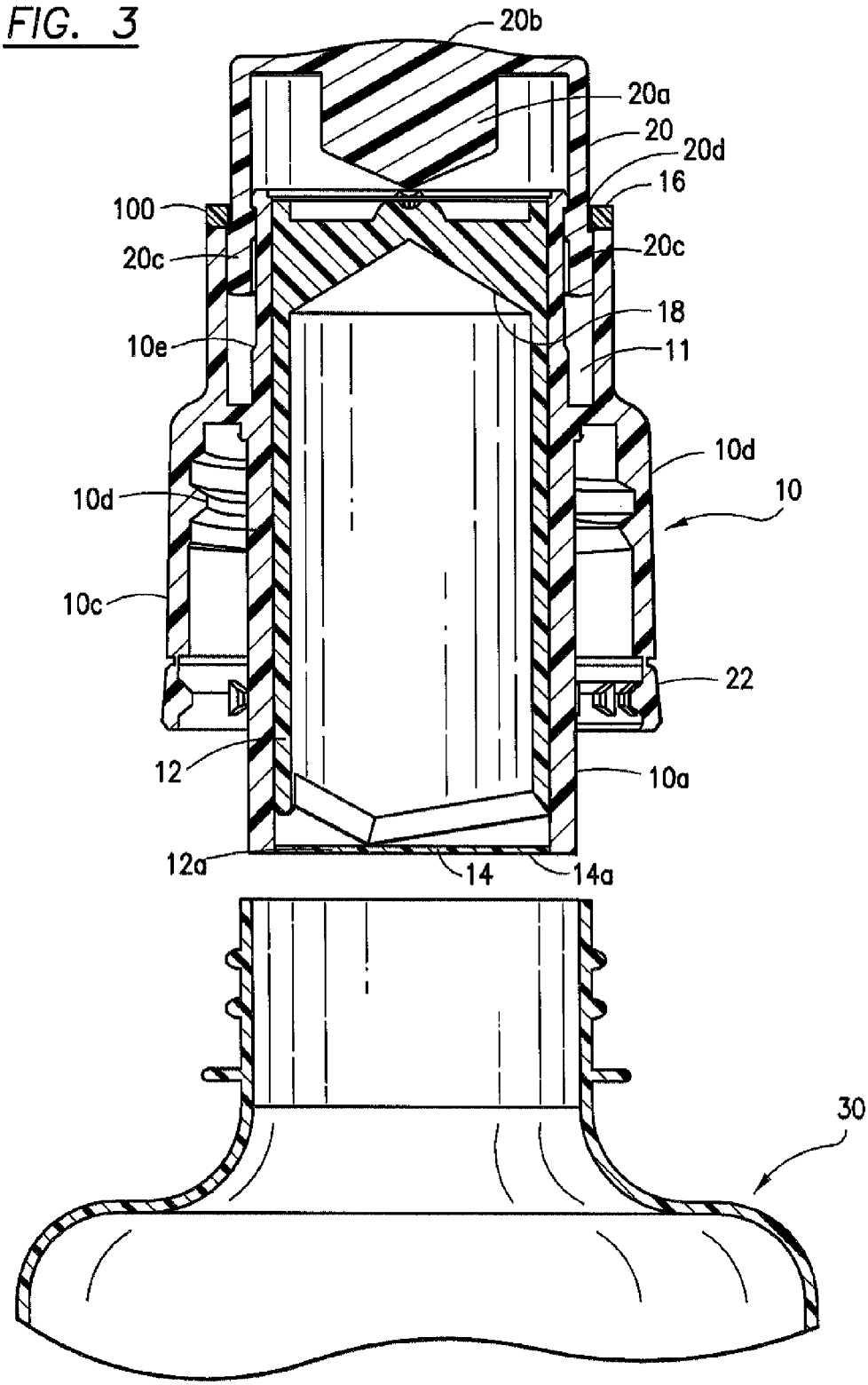
FIG. 3 is an elevational view in cross section of the invention in a non-activated mode shown without ingredients.

Referring now to FIG. 3, the unit is shown in the un-activated position as it would be attached to a primary liquid container such as a water bottle at the threaded neck opening. The cap body 10 includes a molded body portion 10*c* that on its inside cylindrical surface includes fastening threads 10*d* that are helically grooved on the side interior walls of the cap body portion 10*c* which allows the entire dispensing device to be firmly threadably attached to a primary container such as a water bottle 30 that has a threaded neck opening.

As shown in the un-activated position, the button actuator 20 is in a raised position relative to the cap body 10. A safety ring 100 physically prevents the button actuator 20 from being moved downwardly unless there is sufficient enough manual force to break the release ring 100 away from the button actuator 20 which would then allow the button actuator 20 to be forced downwardly in groove 11. The button actuator 20 has a top surface 20*b* that is engaged with the hand or finger to push downwardly to activate the entire system and dispense the ingredients in the storage chamber 12*c*. Button actuator 20 has a internal protrusion 20*a* which may be a pair of trapezoidal or triangularly shaped walls disposed at 90 degrees to each other that have a tip portion that can be depressed against the upper opening wall central area 12*b* that is permanently integrated in the ingredient storage chamber 12. The button actuator 20 may include an interior protrusion 20*d* that engages a lip 10*e* on the outside exterior of the sleeve body 10*a* which acts as a stop for the protrusion 20*d* on the button actuator 20 as its depressed inside slot 11.

The cap body 10 which includes sleeve body 10*a* that receives the ingredient storage chamber 12 and which includes a storage chamber area 12*c* has a base seal 14 extending across the bottom sleeve opening. The seal 14 may be integrated and molded with the cap body 10 and have a line of weakening or it could be a foil seal that has a cap disposed on top of it for sealing purposes such as ring 15 shown in FIG. 2. However, as shown in FIG. 3, the seal 14 would include a line of weakening 14*a*. When the button actuator 20 is depressed downwardly the ingredient storage chamber 12 is forced downwardly inside sleeve body 10*a* and the bottom blade and cutting edge of the ingredient storage chamber 12 is depressed against the base seal 14 causing the seal to be torn and ripped open, allowing any material or ingredients whether liquid or powder disposed in ingredient storage chamber 12*c* to be dispensed into the primary container 40 to which the entire cap body is attached such as a water bottle 30.

Figure 4:
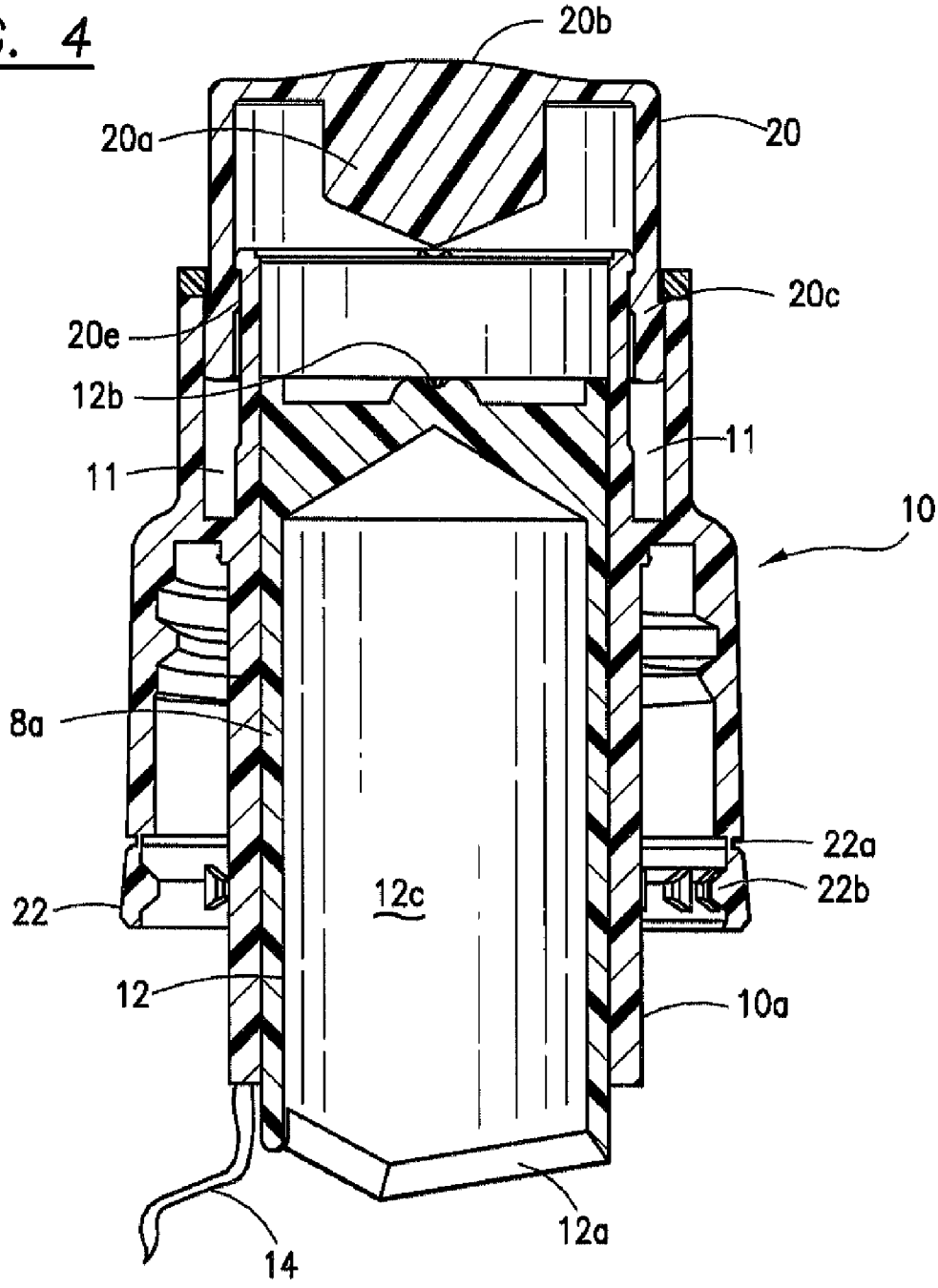
FIG. 4 is an elevational view in cross section as the invention appears after activation.

The dispensing device is shown in FIG. 4 after button actuator 20 has been manually depressed and the contents in the ingredient storage chamber 12*c* have been dispensed into a primary container. As shown in FIG. 4, the seal 14 that had sealed sleeve 10*a* of cap body 10 and the ingredients in the storage chamber 12 have been release as evidence by the ripped apart seal 14. Thus the material inside whether liquid or powder that were previously housed and sealed in the ingredient storage chamber 12*c* have been released. In FIG. 4 the button actuator is shown raised back to its initial position after having pushed and manually depressed area 12*b* in the ingredient storage chamber downwardly so that the base of 12*b* and the cutting 12*a* note that the storage chamber 12 slides inside of sleeve 10*a* which is integrally formed with the entire unit of cap body 10.

In summary the device is comprised of the button actuator 20 which includes a cylindrical chamber and a conical plunger 20*a*, a moveable cylindrically shaped ingredient storage chamber 12 and a primary container threaded cap 10 which itself has a sleeve passage way disposed there through that is sealed on its bottom side 14 before the device is actuated. Note that in use the device has been connected to a primary container that has a threaded circular neck opening sealed with a locking ring 22. The entire cap and dispensing device cannot be removed from the body without breaking the safety ring 22. Once the ingredients have been dispensed into the primary container, in order to access the mixed ingredients that are in the primary container and in the storage chamber, the entire cap body 10 and the entire device must be removed from the primary container such as a bottle so that the content can be poured out or be withdrawn from the bottle itself such as by drinking the liquid inside.

The present invention can also be used not only on a bottle that includes a neck and a screw on cap, but installed permanently on the threaded circular opening of any carton, container, package or bottle.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A dispensing device and ingredient storage cap for a primary container that contains liquid and/or dry material to be subsequently dispensed into a primary container comprising:

a cap body that is impervious to liquid having an annular wall for attachment to a container;

said cap body, including a cylindrical longitudinal sleeve coaxially disposed inside said annular wall;

said cap body cylindrical sleeve having a top opening and a sealed closed bottom with lines of weakening;

an ingredient storage chamber moveably mounted within said cap body cylindrical sleeve and having a upper contact area and an open bottom including a bottom cutting edge; and a button actuator having an internal protrusion defined by a pair of triangularly shaped walls disposed perpendicularly to one another and delimiting a tip, said actuator connected moveably to said cap body and said tip engageable with said upper contact area of said ingredient storage chamber to depress and move to break said sleeve sealed closed bottom; and a safety ring attached around said button actuator and contacting said cap body, said safety ring detached by downward force on said bottom actuator to allow dispensing.

2. A device as in claim 1, wherein:

said cap body sleeve is cylindrical and said storage chamber is cylindrical; and the inside diameter of said sleeve being larger than the outside diameter of the said storage chamber.

3. A device as in claim 2, wherein:

said sleeve sealed bottom having a joined area of weakened material around its periphery, for rupture by any means using said storage chamber engaging bottom sleeve wall.

4. A device as in claim 1, wherein:

said cap body includes a desiccant within said storage chamber.

5. A device is in claim 1, wherein:

said sleeve bottom seal is manufactured of a metal foil.

6. A device is in claim 4, wherein:

said sleeve bottom seal includes a line of weakening.

* * * * *